US008092576B2

(12) United States Patent
Allan

(10) Patent No.: US 8,092,576 B2
(45) Date of Patent: Jan. 10, 2012

(54) MAST ELECTRODE DESIGN

(75) Inventor: Robert A. Allan, Kitchener (CA)

(73) Assignee: Turbosonic Inc., Waterloo, Ontario (CA)

( * ) Notice: Subject to any disclaimer, the term of this patent is extended or adjusted under 35 U.S.C. 154(b) by 793 days.

(21) Appl. No.: 11/884,553

(22) PCT Filed: Feb. 16, 2006

(86) PCT No.: PCT/CA2006/000238
§ 371 (c)(1),
(2), (4) Date: Aug. 11, 2008

(87) PCT Pub. No.: WO2006/086886
PCT Pub. Date: Aug. 24, 2006

(65) Prior Publication Data

US 2009/0107338 A1 Apr. 30, 2009

Related U.S. Application Data

(60) Provisional application No. 60/653,768, filed on Feb. 18, 2005.

(51) Int. Cl.
*B03C 3/41* (2006.01)

(52) U.S. Cl. ..... 95/57; 96/49; 96/83; 96/92; 96/95; 313/237; 313/357

(58) Field of Classification Search ..... 96/49, 83, 96/84, 92, 95–100; 95/57; 313/237, 267, 313/356, 357; 248/333
See application file for complete search history.

(56) References Cited

U.S. PATENT DOCUMENTS

| | | | | | |
|---|---|---|---|---|---|
| 1,322,163 | A | * | 11/1919 | Conover | 96/97 |
| 1,399,422 | A | * | 12/1921 | Chubb | 96/95 |
| 1,793,664 | A | * | 2/1931 | Anderson | 96/91 |
| 2,712,362 | A | * | 7/1955 | Winklepleck | 96/29 |
| 3,046,716 | A | * | 7/1962 | Rodger | 96/97 |
| 3,297,903 | A | * | 1/1967 | Riek | 313/355 |
| 3,495,123 | A | * | 2/1970 | Raddatz | 313/357 |
| 3,716,966 | A | * | 2/1973 | De Seversky | 96/48 |
| 3,765,154 | A | * | 10/1973 | Hardt et al. | 96/88 |
| 4,155,792 | A | * | 5/1979 | Gelhaar et al. | 156/172 |
| 4,318,719 | A | * | 3/1982 | Kato et al. | 96/91 |
| 4,360,367 | A | | 11/1982 | Prior | |
| 4,375,364 | A | * | 3/1983 | Van Hoesen et al. | 96/87 |
| 4,948,399 | A | * | 8/1990 | Reuffurth et al. | 96/92 |
| 5,248,324 | A | * | 9/1993 | Hara | 96/37 |
| 5,344,481 | A | * | 9/1994 | Pettersson | 96/33 |
| 5,401,302 | A | * | 3/1995 | Schulmerich et al. | 96/71 |
| 5,603,752 | A | * | 2/1997 | Hara | 96/39 |
| 6,004,375 | A | * | 12/1999 | Gutsch et al. | 95/57 |
| 6,579,349 | B1 | * | 6/2003 | Ting et al. | 96/44 |
| 6,620,224 | B1 | | 9/2003 | Sato | |

(Continued)

FOREIGN PATENT DOCUMENTS

| | | |
|---|---|---|
| CA | 2505248 | 5/2004 |

(Continued)

*Primary Examiner* — Richard L Chiesa
(74) *Attorney, Agent, or Firm* — Michael I. Stewart; Sim & McBurney

(57) ABSTRACT

A mast electrode design for a wet electrostatic precipitator including a first and a second electrode section connected together via a connector assembly. The connector assembly includes an axial protrusion extending from an end of the first electrode section which is inserted into an axial bore formed in an end of the second electrode section.

5 Claims, 2 Drawing Sheets

U.S. PATENT DOCUMENTS

2005/0045038 A1 * 3/2005 Huang ..... 96/83

FOREIGN PATENT DOCUMENTS

| | | | |
|---|---|---|---|
| CA | 2505248 | A1 * | 5/2004 |
| GB | 553420 | | 5/1943 |
| JP | 6-190300 | A * | 7/1994 |
| JP | 10-202142 | | 4/1998 |
| JP | 10-202142 | A * | 8/1998 |
| WO | WO 90/05027 | | 5/1990 |
| WO | WO 90/05027 | A1 * | 5/1990 |
| WO | WO 92/19380 | | 11/1992 |
| WO | WO 92/19380 | A1 * | 11/1992 |

* cited by examiner 22
20
24

22
33
28
32
26
30
34
35
24

MAST ELECTRODE DESIGN

REFERENCE TO RELATED APPLICATIONS

This application is a U.S. National Phase filing under 35 USC 371 of International Application No. PCT/CA2006/00238 filed Feb. 16, 2006, which in time, claims priority under 35 USC 119(e) from U.S. Provisional Patent Application No. 60/653,768 filed Feb. 18, 2005.

FIELD OF INVENTION

The present invention is concerned with a mast electrode design for a wet electrostatic precipitator (WESP).

BACKGROUND OF THE INVENTION

WESPs provide efficient emission controls for submicron particulates, heavy metals, acid mists, fumes, dioxins and furans. WESPs are specifically designed to handle process gas cleaning problems at low capital and operating costs. One form of WESP is described in WO 92/19380, the disclosure of which is incorporated herein by reference.

WESPs are adaptable to a wide variety of gas cleaning operations and are particularly effective at collecting submicron particles, regardless of the physical or chemical nature of the collected material. WESPs contrast with alternative collection methods, such as scrubbers, fabric filters and dry electrostatic precipitators, which are often sensitive to the composition of the collected material.

The WESP usually consists of a bundle of vertical discharge tubes, often of hexagonal shape, each tube having a high-voltage rigid rod-like (mast) electrode axially arranged therein. Gas enters the WESP, where it is evenly distributed across the tube bundle. Incoming particles are given a strong negative charge by a high density ionizing corona produced by the high voltage electrodes. As the gas flows through the vertical discharge tubes, the action of the electric field on the charged particles causes them to migrate to the grounded walls of the tubes where they accumulate. The self-washing action of a water film that falls down the inside of the tube removes the collected material to a discharge drain.

SUMMARY OF INVENTION

The present invention is directed to a device that facilitates the replacement of the rod-like electrode. One difficulty with the WESP is replacing damaged or non-functioning electrodes. Generally, when an electrode is to be replaced, it is necessary to cut a hole in the bottom of the unit or remove the upper part of the housing.

Accordingly, in one aspect of the present invention, there is provided a mast electrode assembly for a wet electrostatic precipitator, which comprises a first and a second electrode section, each said electrode section being cylindrical and hollow and having a closure thereto at each end of the electrode section, and a connector assembly connecting one end closure of said first electrode section to one end closure of said second electrode section, said connector assembly comprising an axial protrusion extending from said one end closure of said first electrode section in friction fit relationship into an axial bore formed in said one end closure of said second electrode section with adjacent surfaces of said one end closures of said first and second electrode section in abutting relationship.

In accordance with another aspect of the present invention, there is provided a wet electrostatic precipitator, comprising a housing, a bundle of vertical discharge tubes, a high-voltage rigid rod-like electrode axially arranged in the tube, an upper inlet and a lower outlet, at least one of said electrode assembly being a mast electrode assembly as defined above.

In accordance with a further aspect of the present invention, there is provided a method of replacement of a damaged or non-functioning electrode in a wet electrostatic precipitator, said wet electrostatic precipitator comprising a housing, a bundle of vertical discharge tubes in said housing, each tube having a high-voltage rigid, rod-like electrode axially arranged therein, an upper inlet plenum to said housing and a lower outlet plenum from said housing, an access door for said upper inlet plenum and an access door for said lower outlet plenum, which comprises providing a high-voltage rigid mast electrode comprising separate first and second electrode sections, each electrode section being cylindrical and hollow and having a closure thereto at each end of said electrode section, a two-part connector assembly for connecting one end closure of said first electrode section to one end closure of said second electrode section, one part of said connector assembly comprising an axial protrusion extending from said one end closure of said first electrode section and the second part of said connector assembly comprising an axial bore formed in said one end closure of said second electrode section for receiving said protrusion in friction fit relationship with said bore with adjacent surfaces of said one end closures of said first and second electrode sections in abutting relationship, removing the damaged or non-functional electrode from the tube in which it is located, inserting one of said electrode sections part-way into the tube from which the damaged or non-functional electrode has been removed, joining the other of said electrode sections with said one electrode section to form a replacement electrode, and inserting the replacement electrode the whole way into the tube from which the damaged or non-functional electrode has been removed.

In accordance with the present invention, therefore, after the existing damaged or non-functioning electrode has been removed, the new electrode is replaced in sections. One section is lowered into the tube, a part of the connector assembly is connected to the upper end of the electrode section and another electrode section, with a mating part of the connector assembly attached to the bottom of the electrode section, then is connected to the first section and both sections lowered into place.

DESCRIPTION OF PREFERRED EMBODIMENT

Figure 1:
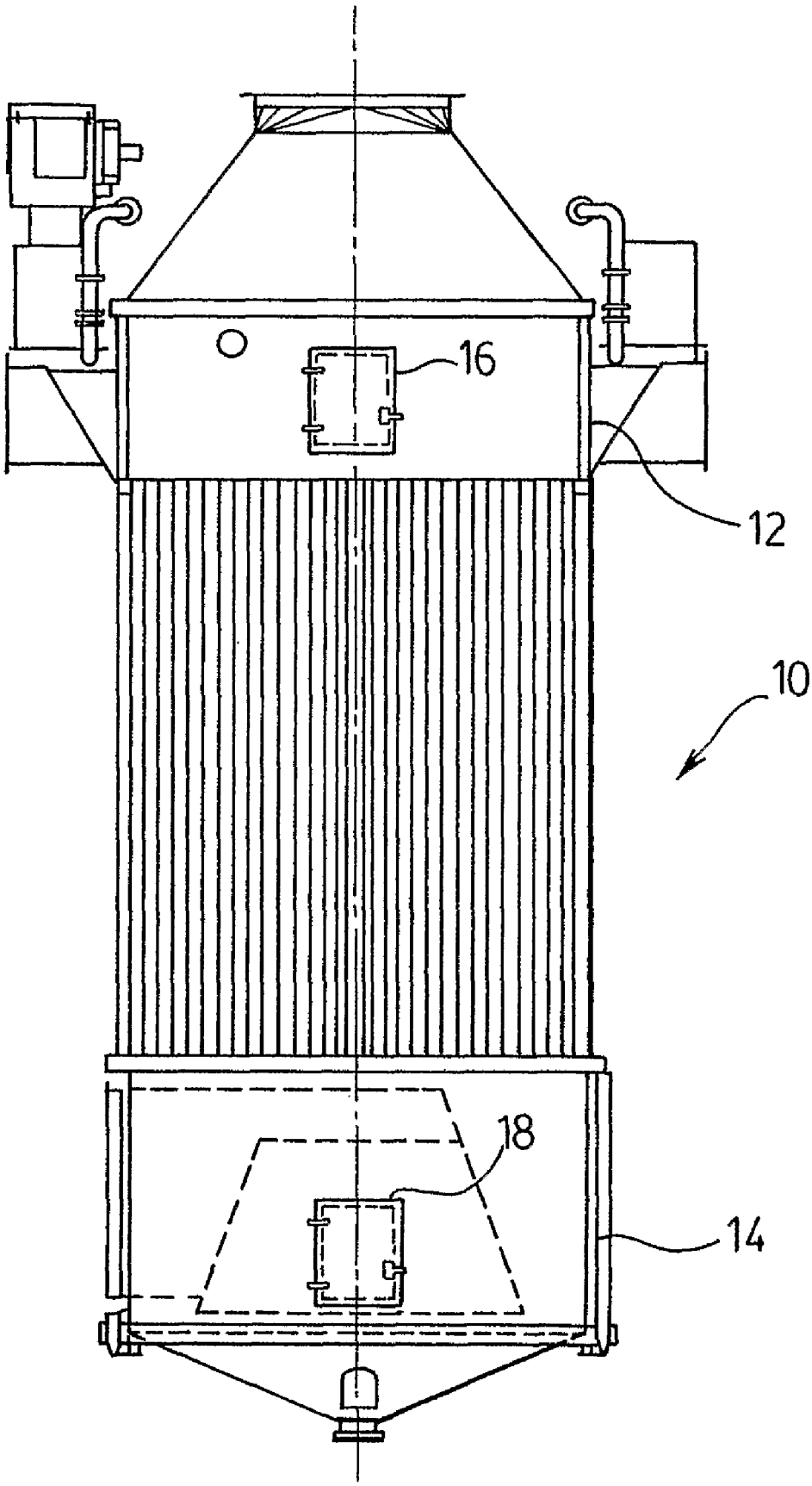
FIG. 1 is an elevational view of a WESP unit, showing the access doors.

Referring to the drawings, a WESP 10 of conventional construction is shown in FIG. 1. Both the inlet plenum 12 and the outlet plenum 14 have access doors 16 and 18 to permit access to the interior of the plenum.

Figures 2, 3:
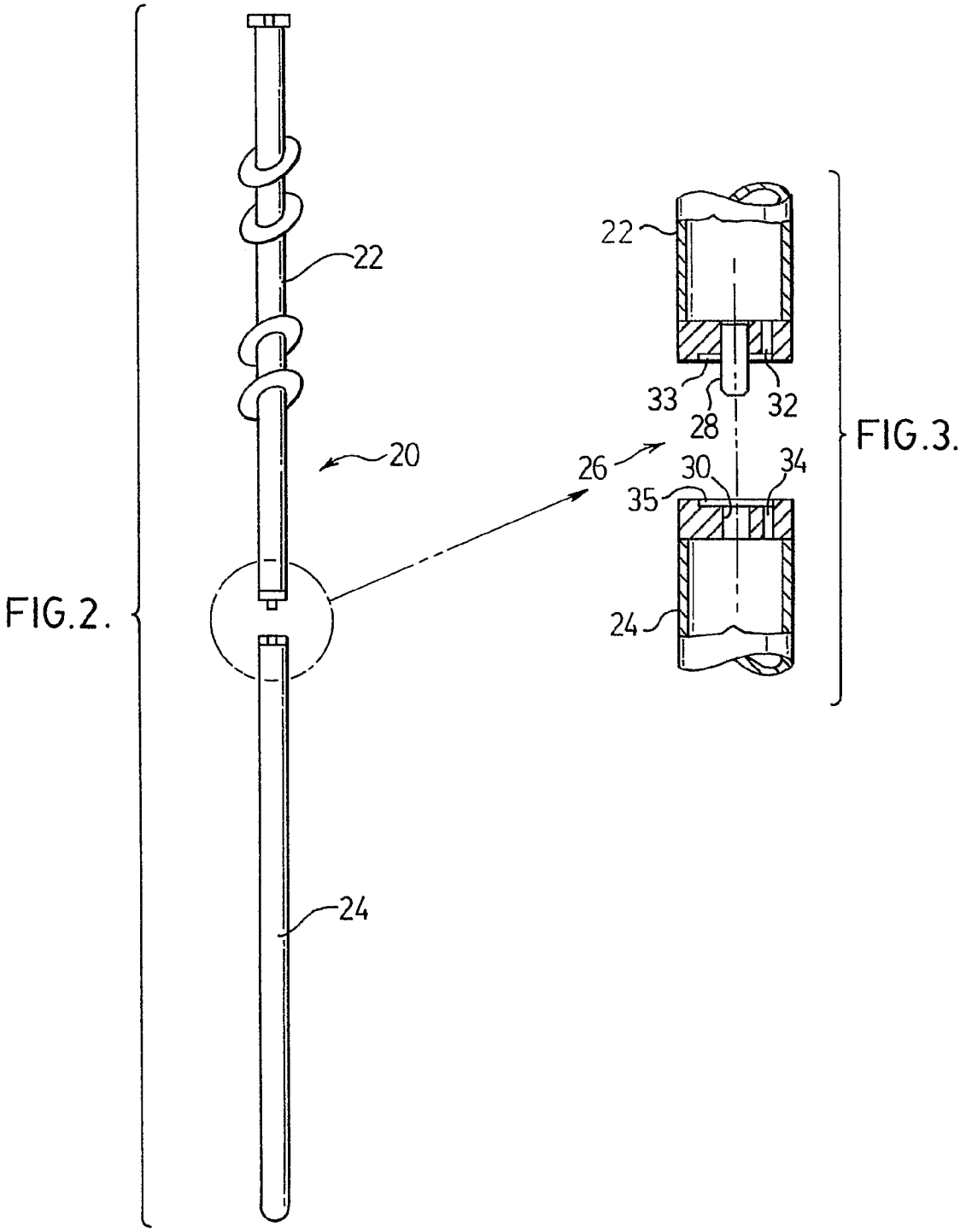
FIGS. 2 and 3 show a segmented mast electrode according to one embodiment of the invention.

FIGS. 2 and 3 show a mast electrode assembly 20 comprising an upper electrode section 22 and a lower electrode section 24 which are joined by a connector assembly 26. The connector assembly 26 includes an alignment pin 28 associated with the upper mast electrode 22 and an opening 30 associated with the lower mast electrode 24 for frictional fit mating relationship with the alignment pin 28. The reverse arrangement may be used, if desired. The connector assembly

26 also includes a drainage hole 32 in the upper connector assembly portion and a recess 33 in the surface of the upper connector assembly portion, and a drainage hole 34 in the lower connector assembly portion and a recess 35 in the surface of the lower connector assembly portion to permit condensed moisture to pass through the electrode assembly 20.

The segmented mast electrode assembly 20 may be formed in any convenient manner. One procedure which may be used is as follows: A mast electrode is fabricated and assembled. The mast electrode is cut into upper and lower mast electrode assemblies. The alignment pin then is aligned and installed in the upper assembly. The upper connector with alignment pin then is installed on the upper mast electrode assembly. The lower connector then is installed onto the lower mast electrode assembly.

Using the novel segmented electrode assembly, the damaged electrode is raised and/or lowered and cut into sections and then removed through the upper and/or lower access doors 16 and 18. The lower mast electrode assembly 24 is placed into the inlet plenum and then inserted into the tube from which the damaged electrode was removed, with a wire or a hook at the top of the tube to hold the assembly in place. The upper mast electrode assembly 22 then is placed in the inlet plenum and attached to the lower mast electrode assembly 24. The entire mast electrode then is lowered into the tube and attached to the high voltage support grid.

Alternatively, the mast electrode may be installed through the lower plenum in like manner. The mast electrode is illustrated as being hollow. However, the electrode may be solid, if desired.

SUMMARY OF DISCLOSURE

In summary of this disclosure, the present invention provides a connector for connecting electrode segments to facilitate replacement of electrodes in a WESP. Modifications are possible within the scope of the invention.

The invention claimed is:

1. A mast electrode assembly for a wet electrostatic precipitator, which comprises:

a first and a second electrode section, each said electrode section being cylindrical and hollow and having a closure thereto at each end of the electrode section, and a connector assembly connecting one end closure of said first electrode section to one end closure of said second electrode section, said connector assembly comprising an axial protrusion extending from said one end closure of said first electrode section in friction fit relationship into an axial bore formed in said one end closure of said second electrode section with adjacent surfaces of said one end closures of said first and second electrode sections in abutting relationship.

2. The electrode assembly of claim 1 wherein each said abutting surface of said one end closure of said first and second electrode section has a recess formed therein and said one end closure of each of said first and second electrode sections has a passage formed therethrough establishing fluid flow relationship between an interior of said first and second electrode sections and said recess formed in the respective surfaces of the one end closure of the first and second electrode sections.

3. The electrode assembly of claim 2 wherein the other end closure of each of said first and second electrode sections has an opening therethrough.

4. A wet electrostatic precipitator, comprising a housing, a bundle of vertical discharge tubes, a plurality of high-voltage rigid rod electrodes axially arranged in the tubes, an upper inlet and a lower outlet, at least one of said electrodes being a mast electrode assembly as claimed in claim 1.

5. A method of replacement of a damaged or non-functioning electrode in a wet electrostatic precipitator, said wet electrostatic precipitator comprising a housing, a bundle of vertical discharge tubes in said housing, each tube having a high-voltage rigid, rod electrode axially arranged therein, an upper inlet plenum to said housing and a lower outlet plenum from said housing, an access door for said upper inlet plenum and an access door for said lower outlet plenum, which comprises:

providing a high-voltage rigid mast electrode comprising separate first and second electrode sections, each electrode section being cylindrical and hollow and having a closure thereto at each end of said electrode section, a two-part connector assembly for connecting one end closure of said first electrode section to one end closure of said second electrode section, one part of said connector assembly comprising an axial protrusion extending from said one end closure of said first electrode section and the second part of said connector assembly comprising an axial bore formed in said one end closure of said second electrode section for receiving said protrusion in friction fit relationship with said bore with adjacent surfaces of said one end closures of said first and second electrode sections in abutting relationship, removing the damaged or non-functional electrode from the tube in which it is located, inserting one of said electrode sections part-way into the tube from which the damaged or non-functional electrode has been removed, joining the other of said electrode sections with said one electrode section to form a replacement electrode, and inserting the replacement electrode the whole way into the tube from which the damaged or non-functional electrode has been removed.

* * * * *